US005943852A

United States Patent [19]

König

[11] Patent Number: 5,943,852

[45] Date of Patent: Aug. 31, 1999

[54] METHOD OF AN APPARATUS FOR PRODUCING THICK/THIN AND/OR COLOR EFFECTS YARN

[75] Inventor: Günter König, Uhingen, Germany

[73] Assignee: Zinser Textilmaschinen GmbH, Ebersbach/Fils, Germany

[21] Appl. No.: 08/969,138

[22] Filed: Nov. 12, 1997

[30] Foreign Application Priority Data

Dec. 12, 1996 [DE] Germany ..... 196 51 782

[51] Int. Cl.[6] ..... D01H 13/26

[52] U.S. Cl. ..... 57/287; 28/240; 28/243; 57/6; 57/18; 57/288; 57/289

[58] Field of Search ..... 57/3, 6, 10, 17, 57/18, 284, 287, 288, 289, 290; 28/240, 243, 245

[56] References Cited

U.S. PATENT DOCUMENTS

| | | | |
|---|---|---|---|
| 3,844,103 | 10/1974 | Sasaki et al. | 57/284 |
| 4,044,089 | 8/1977 | Cochran et al. | 264/169 |
| 4,528,807 | 7/1985 | Durand | 57/6 |
| 5,568,719 | 10/1996 | Proctor | 57/3 |

FOREIGN PATENT DOCUMENTS

| | | | |
|---|---|---|---|
| 196 26 031 A1 | 10/1997 | Germany . | |
| 40529 | 9/1985 | Japan | 28/243 |
| 1070033 | 4/1986 | Japan | 57/3 |
| 3-287830 | 12/1991 | Japan | 57/284 |
| 192743 | 11/1994 | Japan | 28/243 |
| 1064657 | 4/1967 | United Kingdom . | |

OTHER PUBLICATIONS

Verfahren zum Erzeugen von periodischen Feinheits–s-chwankungen an fadenförmigen Gut, Dr. rer. nat. Tatjana Sinjunkowa, KDT, Technishe Universität Karl–Marz–Stadt, Sektion Textil–und Ledertechnick, pp. 229–233.

*Primary Examiner*—William Stryjewski
*Attorney, Agent, or Firm*—Herbert Dubno

[57] ABSTRACT

A thick/thin and/or color effect composite yarn is produced by depositing a sheath of one or more effect threads on a thick/thin filament yarn in which the thick regions are incompletely stretched, and the resulting assembly is then subjected to stretching to full stretch-out thicker regions.

20 Claims, 3 Drawing Sheets

METHOD OF AN APPARATUS FOR PRODUCING THICK/THIN AND/OR COLOR EFFECTS YARN

FIELD OF THE INVENTION

The present invention relates to a method of and to an apparatus for producing thick/thin and/or color effects in a filament yarn utilizing stretching techniques.

BACKGROUND OF THE INVENTION

It is desirable, in the textile arts, to impart especially to synthetic yarns, i.e. monofilamentis [or multifilaments] which may be spun from a synthetic resin through a spinneret, various textures or "effects" to improve the "hand" or appearance of fabric which is made from such yarn filaments.

It has been proposed, for example, to form synthetic filament yarns or, more generally, synthetic filaments, with alternating thick and thin regions. However, such yarns tend to be incompletely stretched over sections of the length of the filament and, since stretch improves the molecular orientation and hence the crystallinity of the filament, in some cases, the thick/thin filaments which resulted had insufficient strength in the regions of less stretch and were more sensitive to deterioration the presence of light in such regions. The elongation properties also were reduced in the regions of less stretch.

In practice, incompletely stretched filaments were not usable for curtains and the like which had to be subjected to relatively intense light over many years because the filament strength would deteriorate to say a third of the original strength and the elongation to break could be reduced from 30% to 5%, representing a major deterioration of quality. The production of variations in the thickness of a filament is described, inter alia in the publication for "Verfahren zum Erzeugen von periodischen Feinheitschwankungen an fadenförmigem Gut" by Tatjana Sinjunkowa, KDT, Technische Universität Karl-Marx-Stadt, Sektion Textil- und Ledertechnik, Textiltechnik Volume 39 (1989), No. 5, pg. 229 ff.

OBJECTS OF THE INVENTION

It is an object of the present invention, therefore, to provide an improved method of making an effect yarn, i.e. a thick/thin and/or color-effect yarn whereby drawbacks of earlier systems are avoided, and, in particular, long-term exposure to light will not result in the significant deterioration previously alluded to and the product yarn will be of high strength and retain that strength for long periods of time.

Another object of this invention is to provide an improved method of producing thick/thin and/or color effects in a filament yarn which can yield a product of high quality.

SUMMARY OF THE INVENTION

These objects are attained, in accordance with the invention in that a filament yarn which is not completely stretched in certain regions, i.e. a filament yarn having thick regions alternating with thinner regions which have been at least partially stretched, is sheathed over its entire length with at least one effect thread and the resulting assembly is then fully stretched so that the previously incompletely stretched regions now are fully stretched and thus fully oriented.

The term "incompletely stretched" or other terms implying less than full stretch, are intended to refer to the state of a synthetic resin filament in which in those regions the filament is incompletely oriented. In other words a fully-stretched filament or one which is fully stretched at least in certain regions, and in these regions is a filament with the maximum molecular orientation obtainable with stretching and which has been stretched to the extent which will yield maximum strength. Any greater stretch may exceed the yield strength of the filament or might serve to weaken it. A complete stretch, therefore, both for the filament as a whole and for the particular region of the filament in question is a stretch which will yield maximum strength and thus maximum orientation for that filament or region.

Of course, that means that the starting yarn filament must be an incompletely oriented filament or yarn, i.e. one which is not completely stretched in the sense of the description given previously. Preferably the yarn or filament which is used will be a preoriented yarn (POY) and one which may have alternating thick and thin regions. The thin regions may have a greater degree of stretch or molecular orientation than the thick regions and the thick regions may be fully nonoriented, although they usually are partly oriented or stretched while the thin regions may be fully stretched, but usually are less than fully stretched.

Methods of forming such filaments for yarns can be deduced from my commonly-assigned copending applications, Ser. No. 08/823,639 filed 1997 (Attorney's App. 20282) based upon German Applications 196 11 722.4 filed Mar. 25, 1996 and 196 26 031.0 filed Jun. 28, 1996; Ser. No. 08/823,639 filed Mar. 25, 1997 (Attorney's App. No. 20486); Ser. No. 08/940,843 filed Oct. 1, 1997 (Attorney's App. No. 20478) based upon German Application 196 40 405.3 filed Sep. 30, 1996; and Ser. No. 08/823,639 filed Mar. 25, 1997.

More specifically, the method of the invention can comprise the steps of:

(a) forming a yarn filament with spaced-apart regions of incomplete stretch and having more fully stretched regions between the regions of incomplete stretch;

(b) covering the yarn filament over substantially a full length thereof with at least one effect thread to form an assembly of the yarn filament and an effect-thread covering; and (c) thereafter stretching the assembly to fully stretch the regions of incomplete stretch, thereby producing the thick/thin or color effect yarn.

The apparatus can comprise:

means for forming a yarn filament with spaced-apart regions of incomplete stretch and more fully stretched regions between the regions of incomplete stretch;

means downstream of the means for forming along a path of the yarn filament for covering the yarn filament over substantially a full length thereof with at least one effect thread to form an assembly of the yarn filament and an effect thread covering; and means for thereafter stretching the assembly to fully stretch the regions of incomplete stretch thereby reducing the thick/thin or color-effect yarn.

The combined yarn, referred to herein as an assembly or as a composite yarn, consisting of the filament yarns with its thick regions and the sheath formed by effect threads, is thus stretched in the further step with such a stretching ratio (ratio of original length to stretched length) that the previously unstretched or incompletely stretched regions are fully stretched. As a result, the sheath of effect threads spreads out in the previously thick regions which have now been thinned to a density of the sheath in the original thin regions remains the same or is thicker out only to a lesser extent so that along the composite yarn there are regions of greater effect thread density and regions of lesser effect thread density and the result is a unique effect yarn from a color or thick/thin point of view or both without the drawbacks as sensitivity of the yarn strength to light.

The thick/thin effect is itself more pronounced in this system than with smooth filaments because the mass cross section in the regions of greater effect thread density can be significantly higher than in other regions. The effect threads can bulk in these regions to a greater extent than with other methods and thus the apparent thickness of the effect yarn can be greatly enhanced.

The filament yarn can be a synthetic monofilament or even a multistrand filament. The effect yarn can itself be composed of a synthetic material such as a synthetic resin yarn. The effect thread can be composed, if desired, of the same material as the synthetic yarn. The effect thread can, more particularly, be composed of a monofilament or a multistrand filament or from a fine stable fiber yarn of synthetic fibers.

Effect threads which are themselves textured synthetic yarns or yarns of natural endless fibers like silk or stable fibers or cotton, can, of course, also be used. The ensheathing with effect threads can be effected by swirling or whirling the effect threads around and onto the synthetic yarn or by winding the effect thread around the synthetic yarn. The whirling or swirling effect casts loops of effect yarn more or less randomly around and onto the synthetic yarn so that the loops entangle with one another while the winding, as has been described, can draw successive turns of the effect thread around the synthetic yarn with a minimum of free loop formation. The whirling or swirling effect can be accomplished with a nozzle through which the effect yarn is entrained by air from a supply spool while the twisting can be effected by rotating the spindle about an axis of lay turns of effect thread around the synthetic yarn.

The effect thread can be applied uniformly or uniformly along the length of the synthetic yarn. In the latter case the density of the effect threads will vary along the length of the synthetic yarn. Advantageously, the swirling or winding of the effect threads is effected so that the effect threads are unable to slide along the filament yarn, i.e. are tied thereto against slippage along the filament yarn.

The lengths of the effect threads can be substantially greater than the length of the filament yarn with its incompletely stretched regions. In this case, upon the latter stretching of the composite yarn, there is a reduction of the loop or turn density on the regions of the filament yarn which are stretched without the stretching of the effect threads themselves.

Alternatively, the effect thread can be textured thread which can be approximately of the same length as the filament yarn on which the effect threads are wrapped. These effect threads are then stretched during the stretching of the thicker regions so that their texture can largely disappear locally. The result is a relatively smooth effect yarn with thinner portions in which the filament yarn and the texturing effect yarn are stretched out and thicker regions in which the texture of the effect thread is largely maintained.

The apparatus for producing thick/thin and/or color effects in the incompletely oriented yarn filament can include a swirling nozzle supplied with compressed air or the like or a spindle for winding effect thread around the partly stretched synthetic filament and, of course, downstream thereof, means for stretching the composite yarn.

The regions in which the thick and thin segments of the filament are formed can be provided with an input device or upstream device through which the filament is fed and a downstream device engaging the filament so that the filament can be stretched between the two devices. The upstream device can be provided with means for intermittently releasing the retardation of the filament or some other means for intermittently stretching the latter. The means for effecting the intermittent stretching, can, of course, be means for temporarily increasing pull on the filament as well. The devices which grip the filament for the downstream stretching thereof or for producing the thick/thin filament prior to application of the sheath of effect thread can include a gallet as described in the aforementioned applications.

It has been found to be advantageous to provide downstream of the zone in which the composite yarn is stretched, a further spindle for winding the effect thread onto the composite or a swirling nozzle for that purpose.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
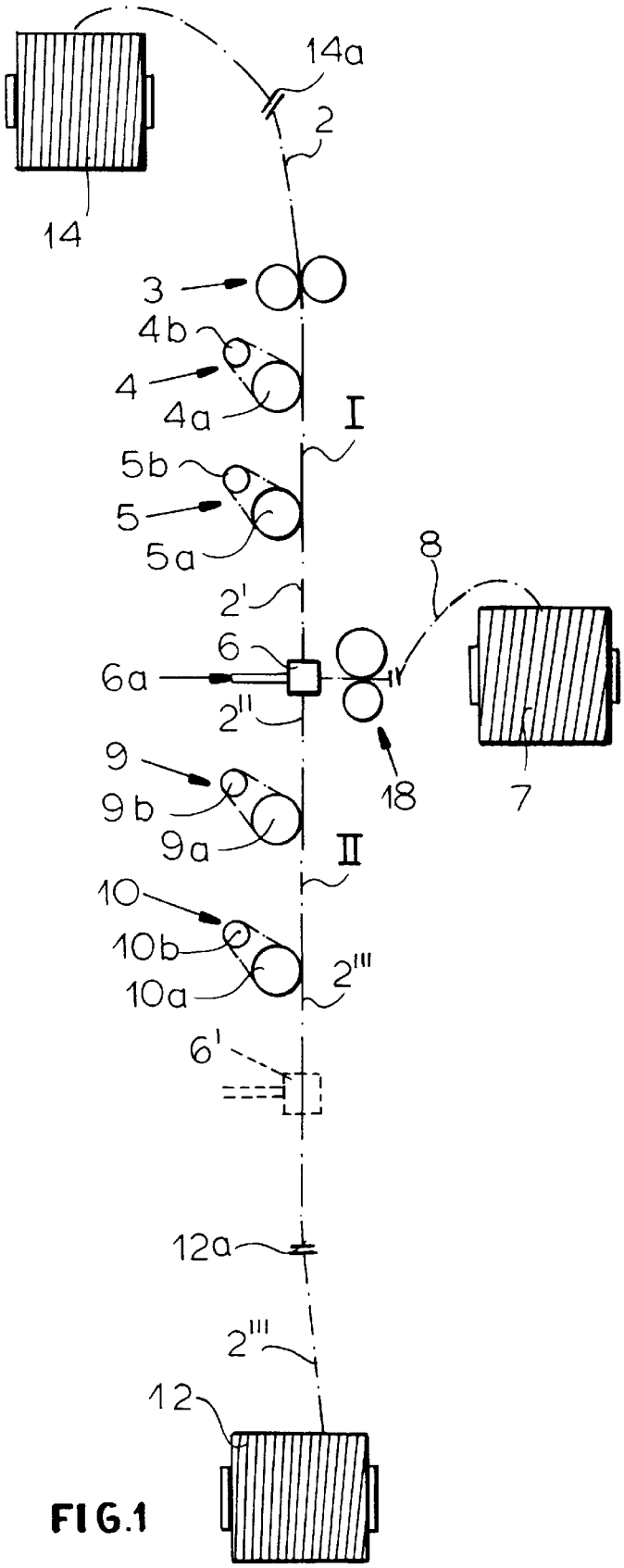
FIG. 1 is a diagram in which a thick/thin filament is provided with a sheath of an effect yarn by winding that spindle or swirling through a nozzle.

FIG. 1 shows a device 1 for producing, especially from an incompletely oriented or not-fully stretched yarn filament 2, shown schematically and preferably a so-called (POY) filament (preoriented) yarn which can be a monofilament or a multifilament yarn.

The incompletely oriented filament yarn 2 is drawn from a spool 14 through an eye 14*a* by a feed-roller pair 3 located upstream of a stretching zone defined between two gallets 4 and 5. In this case, the stretching zone is represented at I. The gallets 4 and 5 have been respective drums 4*a*, 5*a* about which the filament yarn passes in a number of turns, being looped additionally about auxiliary rollers 4*b* and 5*b* as described in the aforementioned copending applications.

Since the yarn 2 is stretched in the zone I, the peripheral speed of the gallet 5 is greater than the peripheral speed of the gallet 4. The speed between the roller pair 3 and the gallet 4 can be of a stretch ratio of 1:1.02 to 1:1.2.

The stretch ratio between the gallets 4 and 5 which, however, does not completely stretch or orient the filament yarn, can be 1:1.3 to 1:1.5.

Figure 2:
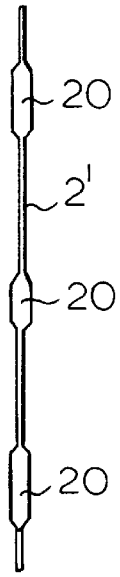
FIG. 2 is an enlarged elevational view of the filament with its thick and thin regions, the thick regions being incompletely stretched.

By means of this incomplete stretching, nonuniformly-spaced and distributed thick regions tend to form with varying lengths along the filament yarn as has been schematically shown in FIG. 2 in the filament yarn 2'. The thick regions have been shown at 20 and, of course, are spaced apart by thinner regions also of varying length. The thick and thin regions in FIG. 2 are as respectively shown to be of the same diameter but in practice may vary in diameter one from another and will have different appearances from that shown in FIG. 2 in the case of multifilament yarns. A filament yarn with incompletely-stretched spaced-apart thicker regions can be formed by other types of apparatus and by other methods including some of those described in the aforementioned copending applications.

According to the present invention, however, regardless of how the filament yarn with its spaced-apart thicker regions which have been incompletely or not fully-stretched or oriented, is then provided with a sheath of one or more effect threads 8 drawn from respective spools 7 and fed, for example, via a feed-roller pair 18 to a device by applying the effect thread or threads around the core formed by the filament yarn 2' with its spaced-apart thicker regions which have been incompletely stretched. In the case illustrated in FIG. 1, this device can be a swirling nozzle supplied with compressed air at 6*a*. A swirling nozzle deposits the effect thread in loops which can intermingle with one another around the synthetic yarn 2' in the formation of the sheath.

Since loops of the effect yarn are provided around the filament yarn 2', the effect thread is fed at a speed substantially greater than the transit speed of the filament yarn through the device 6. The filament yarn is thus surrounded by a relatively dense winding or sheath of the thread or threads.

Figure 3C:
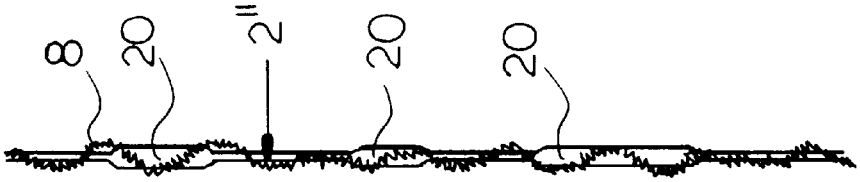
FIGS. 3A–3D represent views of the composite yarns prior to the final stretching and thereafter in accordance with different embodiments of the invention.
Figure 3A:
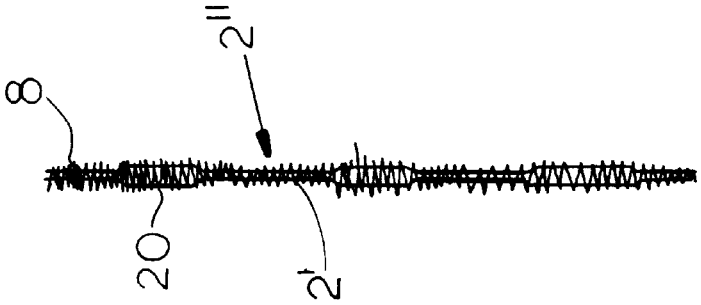

The result, as shown in FIG. 3A, is a thick/thin yarn 2" which is comprised of the original filament core yarn 2' with its thicker regions 20 and the sheath of the effect thread 8 substantially uniformly covering that filament yarn over the length thereof.

The resulting composite 2" is then passed through a second stretching zone II between two gallets 9 and 10 each of which has a drum 9*a* or 10*a* about which the composite yarn 2" passes in a number of turns, and auxiliary rollers 9*b* and 10*b* about which the composite yarn 2" is looped. The gallet 10 operates at a peripheral speed greater than the peripheral composite 2" is then passed through a second stretching zone II between two gallets 9 and 10 each of which has a drum 9*a* or 10*a* about which the composite yarn 2" passes in a number of turns, and auxiliary rollers 9*b* and 10*b* about which the composite yarn 2" is looped. The gallet 10 operates at a peripheral speed greater than the peripheral speed of the gallet 9 and diminished so as to generate in the composite yarn, a full or complete stretching of the thicker regions 20.

Figure 3D:
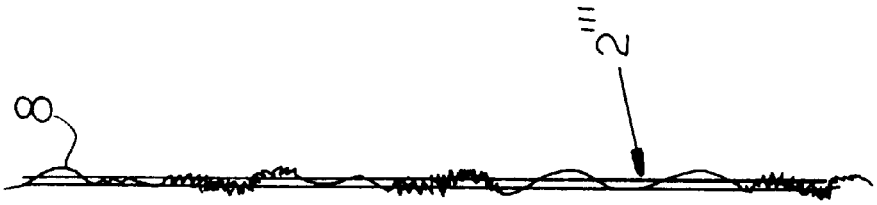
Figure 3B:
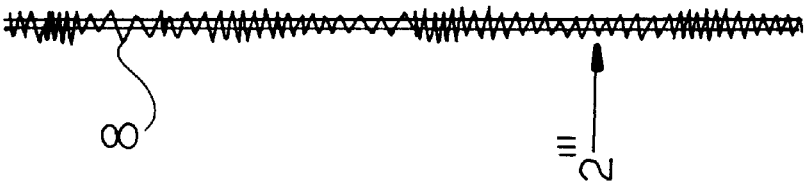

The result is the effect yarn shown in FIG. 3B with its core fully stretched and with the effect threads 8 bunched in the regions previously located between the thicker regions while the effect threads are drawn out in the parts of that yarn at which the thicker regions were formerly located. The effect thread 8 can itself be provided with a texture or of a color different from that of the core yarn, or both to provide thick/thin or color or both thick/thin and color effects in the final yarn 2"' which can be passed through the eye 12*a* and wound up on a take-up spool 12.

In FIG. 3C, the winding of a texturing thread 8, which itself is textured, about the thick/thin filament yarn 2" is shown, without the additional looping so that the effect yarn 8 here is substantially of the same length as that of the filament yarn. The turns of the effect thread 8 around the core yarn 2" are thus of a steep pitch. When this yarn is then stretched between the gallets 9 and 10, both the effect thread 8 and the thick/thin yarn 2" are stretched out and the texturing of the effect thread can be smoothed (compare FIG. 3D) with the core having a generally uniform cross section whereas the texturing thread has greater texture in the regions of lesser stretch of the core yarn and smoother texture in the region of greater stretch of the core yarn.

Regardless of how the composite yarn is formed and stretched, a further swirl nozzle 6' can be provided downstream of the zone II and hence of the gallet 10 to spin in free loops of the effect thread tightly around the core yarn and even, if desired, apply an additional effect thread.

In all embodiments, instead of a swirl nozzle 6 or 6', a spindle 16*a* can be rotated about the axis of the yarn 2' etc. to deposit the effect thread 8 in turns from a spool 16 on the spindle 16*a*.

Figures 4, 5:
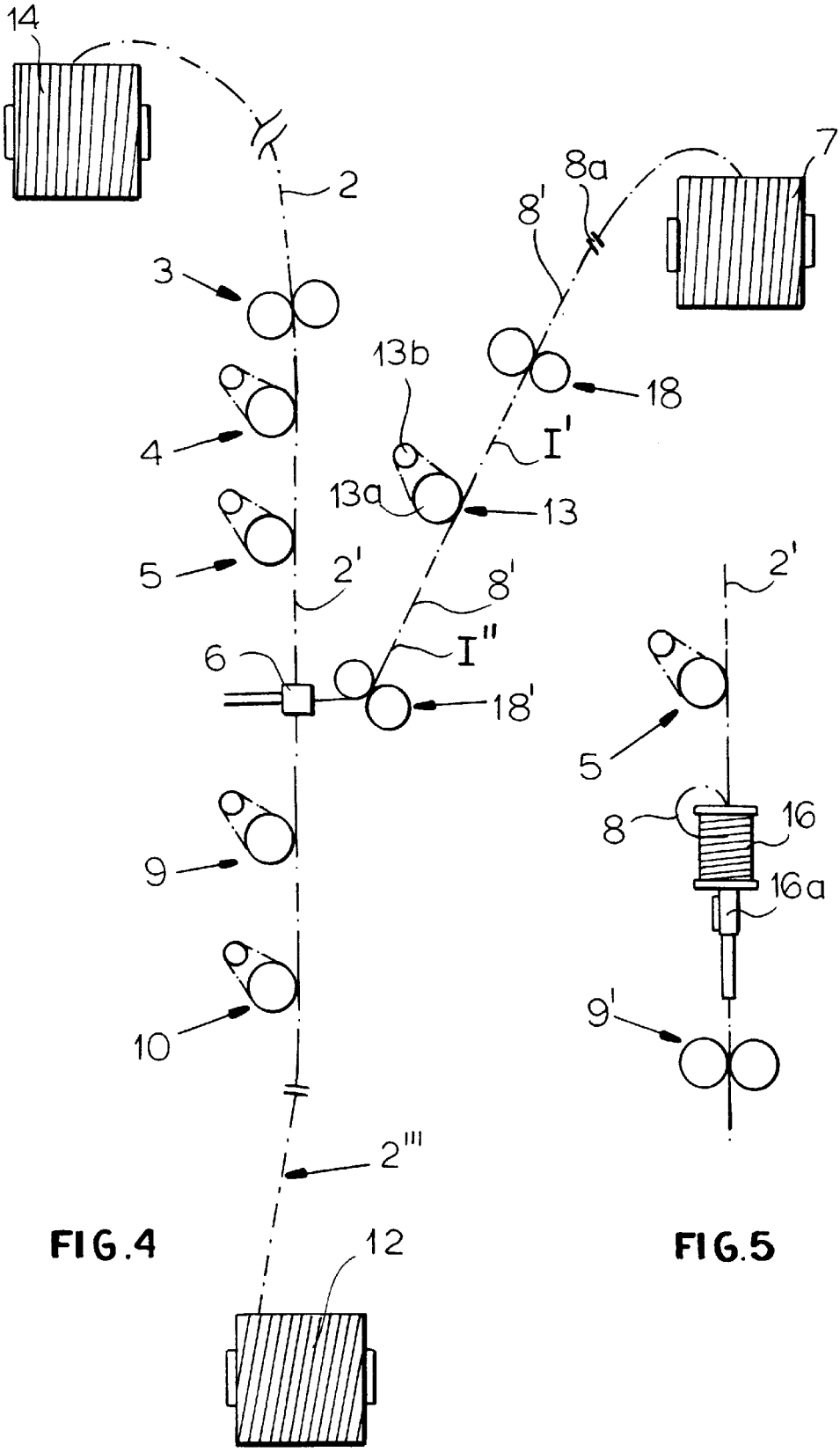
FIG. 4 is an illustration of another embodiment of the invention in which the effect thread is also stretched.
FIG. 5 is an elevational view of a portion of the apparatus in which the swirling nozzle is replaced by a spindle for winding the effect thread around the synthetic filament.

Furthermore, instead of a gallet 9 at the upstream side of the second stretching zone II, the composite yarn can be engaged between a pair of rollers 9' as has also been shown in FIG. 5, for any and all of the embodiments hereof.

The embodiment of FIG. 4 differs from that of FIG. 1 in that the effect thread 8', which is withdrawn from the supply spool 7, is passed through an eye 8*a* of the feed-roller pair 18 which is followed by a gallet 13 comprised of a drum 13*a* around which the effect thread 8' passes in a number of turns, and an ancillary roller 13*b* about which the effect thread is looped. Between the roller pair 18 and the gallet, therefore, a prestretching zone I' is provided in which the prestretch is imparted to the effect thread analogous to that applied to the filament yarn 2 as previously described. The effect thread 8' then passes through the nip of another roller pair operated at a peripheral speed greater than that of the gallet so that a second stretching zone 2" is provided between the gallet and the roller pair 18'. This second stretching zone assists in producing a thick/thin effect in the yarn 8' by analogy to a thick/thin phenomenon described for the yarn 2'.

After the latter yarn has been covered with the effect yarn and subjected to stretching between the gallets 9 and 10, the composite yarn 2"' is wound on the spool 12.

Naturally the covering of the filament yarn 2' by the effect thread or threads can be varied at different point along the path of the yarn 2' to further vary the thick/thin and color effects of the product. For the reasons indicated, the thick/thin and/or color effect composite yarns have improved light resistance and strength and increased durability.

I claim:

1. A method of making a thick/thin or color effect yarn comprising the steps of:

(a) forming a yarn filament with spaced-apart regions of incomplete stretch and having more fully stretched regions between said regions of incomplete stretch;

(b) covering said yarn filament over substantially a full length thereof with at least one effect thread to form an assembly of said yarn filament and an effect-thread covering; and (c) thereafter stretching said assembly to fully stretch said regions of incomplete stretch, thereby producing said thick/thin or color effect yarn.

2. The method defined in claim 1 wherein said effect thread is twirled around the yarn filament having spaced-apart regions of incomplete stretch and more fully stretched regions between said regions of incomplete stretch.

3. The method defined in claim 2 wherein the effect thread is pneumatically laid in loops on said yarn filament with spaced-apart regions of incomplete stretch and more fully stretched regions between said regions of incomplete stretch.

4. The method defined in claim 1 wherein said effect thread is wound in a succession of turns around said yarn filament with spaced-part regions of incomplete stretch and more fully stretched regions between said regions of incomplete stretch.

5. The method defined in claim 1 wherein said effect thread is wrapped regularly round said yarn filament with spaced-apart regions of incomplete stretch and more fully stretched regions between said regions of incomplete stretch.

6. The method defined in claim 1 wherein said effect thread is applied in turns around said yarn filament with spaced-apart regions of incomplete stretch and more fully stretched regions between said regions of incomplete stretch so as to be held against shifting thereon.

7. The method defined in claim 1 wherein the density of said assembly is reduced at least in spaced apart regions of incomplete stretch during stretching of said assembly in step (c).

8. The method defined in claim 1 wherein said effect thread has a length substantially greater than the length of said yarn filament with spaced-part regions of incomplete stretch and more fully stretched regions between said regions of incomplete stretch.

9. The method defined in claim 1 wherein said effect thread is textured and of a length not substantially greater than the length of said yarn filament with spaced-apart regions of incomplete stretch and more fully stretched regions between said regions of incomplete stretch.

10. The method defined in claim 9 wherein the yarn filament and effect thread are twisted together in step (b) to form a twisted assembly which is then stretched in step (c).

11. The method defined in claim 1 wherein said yarn filament with spaced-apart regions of incomplete stretch and more fully stretched regions between said regions of incomplete stretch is an incompletely oriented yarn filament which is subjected to repetitive section-wide changes in stretching.

12. The method defined in claim 1 wherein said yarn filament with spaced-apart regions of incomplete stretch and more fully stretched regions between said regions of incomplete stretch is an incompletely oriented yarn filament which is subjected to varying resistances to stretch over different portions of the length of the yarn filament.

13. An apparatus for making a thick/thin or color-effect yarn comprising:

means for forming a yarn filament with spaced-apart regions of incomplete stretch and more fully stretched regions between said regions of incomplete stretch;

means downstream of said means for forming along a path of said yarn filament for covering said yarn filament over substantially a full length thereof with at least one effect thread to form an assembly of said yarn filament and an effect thread covering; and means for thereafter stretching said assembly to fully stretch said regions of incomplete stretch thereby reducing said thick/thin or color-effect yarn.

14. The apparatus defined in claim 13 wherein said means for covering said yarn filament includes a swirling nozzle for whirling said effect thread in loops onto said yarn filament, and a supply spool for feeding said effect thread to said nozzle.

15. The apparatus defined in claim 13 wherein said means for covering said yarn filament includes a spindle for winding said effect thread around said yarn filament and a supply spool for feeding said spindle with said effect thread.

16. The apparatus defined in claim 13 wherein said means for forming said yarn filament includes an upstream device engaging said yarn filament and a downstream device for engaging said yarn filament and operable to provide a stretch to said yarn filament.

17. The apparatus defined in claim 16, further comprising means for intermittently increasing resistance of said yarn filament to stretch between said devices to form said spaced-apart regions of incomplete stretch having more fully stretched regions between said regions of incomplete stretch.

18. The apparatus defined in claim 16, further comprising means for intermittently relieving engagement of said upstream device with said yarn filament to form the spaced-apart regions of incomplete stretch and having more fully stretched regions between said regions of incomplete stretch.

19. The apparatus defined in claim 16, further comprising a swirling nozzle operating on said assembly downstream of said means for stretching said assembly.

20. The apparatus defined in claim 16, further comprising a winding spindle acting upon said assembly downstream of said means for stretching said assembly.

* * * * *